US007497532B2

(12) United States Patent
Salice

(10) Patent No.: US 7,497,532 B2
(45) Date of Patent: Mar. 3, 2009

(54) CARCASS MEMBER WITH FLAP

(75) Inventor: Luciano Salice, Carimate (IT)

(73) Assignee: Arturo Salice S.p.A., Novedrate (Como) (IT)

( * ) Notice: Subject to any disclaimer, the term of this patent is extended or adjusted under 35 U.S.C. 154(b) by 169 days.

(21) Appl. No.: 10/851,856

(22) Filed: May 21, 2004

(65) Prior Publication Data

US 2006/0103276 A1 May 18, 2006

(30) Foreign Application Priority Data

May 21, 2003 (DE) ..... 203 07 958 U

(51) Int. Cl.
*A47B 96/00* (2006.01)

(52) U.S. Cl. ..... 312/328; 312/323; 312/319.2

(58) Field of Classification Search ..... 312/322, 312/323, 325, 326, 327, 319.1, 319.2, 319.5, 312/319.8, 328; 49/204, 206, 246, 250; 160/188, 160/207, 213
See application file for complete search history.

(56) References Cited

U.S. PATENT DOCUMENTS

| | | | | | |
|---|---|---|---|---|---|
| 2,184,822 | A | * | 12/1939 | Unger | 312/233 |
| 3,112,968 | A | * | 12/1963 | Cotton et al. | 312/248 |
| 4,537,452 | A | * | 8/1985 | Rice et al. | 312/314 |
| 5,409,308 | A | * | 4/1995 | Reuter et al. | 312/319.4 |
| 5,645,333 | A | * | 7/1997 | Sakurai | 312/322 |
| 5,882,099 | A | * | 3/1999 | Salice | 312/328 |
| 5,971,514 | A | * | 10/1999 | Hayakawa | 312/319.2 |
| 6,296,337 | B1 | * | 10/2001 | Kawanabe | 312/319.2 |
| 6,332,660 | B1 | * | 12/2001 | Salice | 312/328 |
| 6,536,860 | B1 | * | 3/2003 | Heidmann et al. | 312/319.2 |
| 2002/0108311 | A1 | * | 8/2002 | Salice | 49/371 |

FOREIGN PATENT DOCUMENTS

| | | | |
|---|---|---|---|
| DE | 1771701 | U | 8/1958 |
| DE | 1887023 | U | 2/1964 |
| DE | 1172058 | | 6/1964 |
| DE | 7013581 | U1 | 7/1970 |
| DE | 2623554 | | 12/1976 |
| DE | 76 38 682 | | 3/1977 |
| DE | 78 11 011 | | 8/1978 |
| FR | 1185442 | | 7/1959 |
| FR | 2065203 | | 7/1971 |
| GB | 2226586 | * | 7/1990 |
| JP | 2-62083 | | 5/1990 |
| JP | 09-252854 | | 9/1997 |
| JP | 11-166349 | | 6/1999 |
| KR | 20-2002-0030968 | | 1/2003 |
| TW | 238630 | | 1/1995 |
| TW | 248225 | | 5/1995 |
| TW | 313991 | | 8/1997 |
| WO | WO 00/23683 | * | 4/2000 |

* cited by examiner

*Primary Examiner*—James O Hansen
(74) *Attorney, Agent, or Firm*—Dilworth & Barrese LLP

(57) ABSTRACT

The invention relates to a carcass member, in particular a cupboard, a chest of drawers or the like, comprising a flap by which the carcass member can be closed and comprising a fitting which has a mounting panel and a support arm connected in its end region to the flap directly or indirectly, with the mounting panel being mounted on the outer side of a wall of the carcass member and with the support arm being pivotally arranged on the mounting panel.

27 Claims, 7 Drawing Sheets

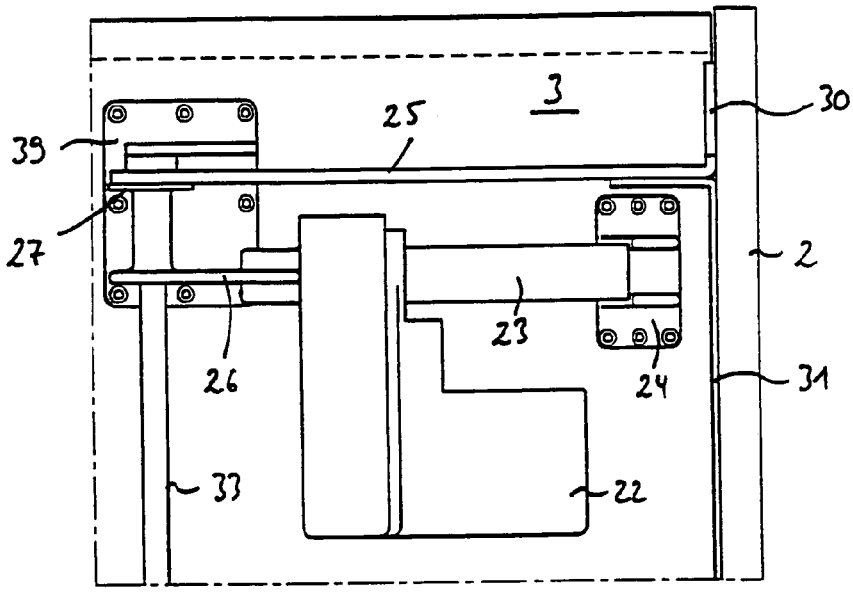
Fig. 11
Fig. 12
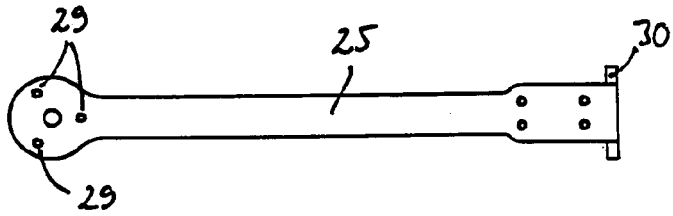
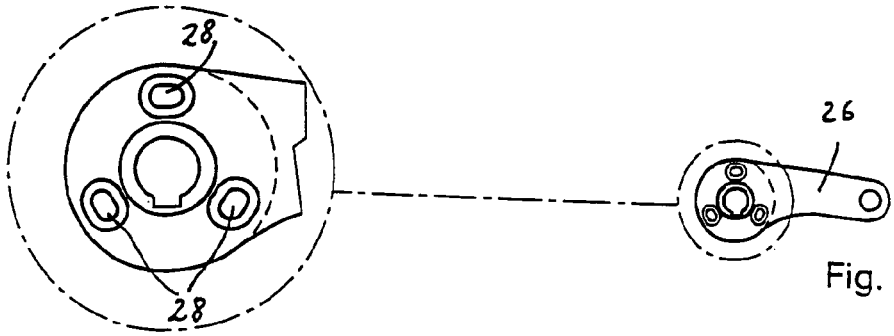
Fig. 13 a
Fig. 13
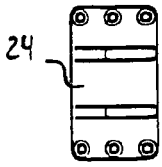
Fig. 16
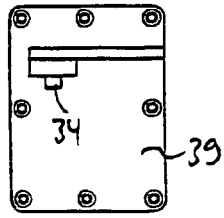
Fig. 15
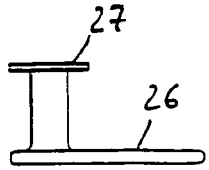
Fig. 14

CARCASS MEMBER WITH FLAP

The present invention relates to a carcass member, in particular to a cupboard or a chest of drawers or the like, comprising a flap by which the carcass member can be closed. The term "flap" is to be understood as any closing members which are pivotally supported around any axes, for example around horizontally or vertically extending axes.

BACKGROUND OF THE INVENTION

Cupboards are known from German patented design specifications DE-GM 76 38 682 and DE-GM 78 11 011 which can be closed by means of flaps pivotally supported around horizontally extending axes. The flaps are movable such that they are not flush, or are only slightly flush, with the cupboard interior in their flipped-up open position so that the opening of the cupboard is substantially completely exposed. The mounting plates of the associated fittings are fastened to the inner side of the side wall of the piece of furniture in the previously known cupboards, which brings about the disadvantage that the interior space of the cupboard bounded by the carcass is restricted by the fitting, i.e. by the mounting plate and the lever mechanism arranged thereon. A disadvantage furthermore exists in that the previously known furniture fittings have a comparatively complex construction and can moreover be mounted comparatively awkwardly due to their arrangement on the inner side of the cupboard.

SUMMARY OF THE INVENTION

It is the object of the present invention to provide a cupboard of the initially recited type comprising a furniture fitting which can be manufactured and mounted easily and which permits the complete utilisation of the interior space of the carcass member.

This object is solved by a carcass member, in particular a cupboard, a chest or drawers or the like, comprising a flap by which the carcass member can be closed. A fitting is furthermore provided which has a mounting panel and a support arm connected at its end region directly or indirectly to the flap, with the mounting panel being mounted to the outer side of a wall of the carcass member and with the support arm being pivotally arranged on the mounting plate.

The interior space of the carcass member can be utilised completely since there are no fitting parts on the inner side. The movement of the flap is defined by the support arm which is connected to the flap in an end region and which is pivotally connected to the mounting panel mounted to the outer side of a wall of the carcass member.

The wall can be formed by the top board of the carcass member. In this case, a flap results which can be pivoted up and is pivotable by means of the support arm, with the support arm being pivoted in this case around axes extending substantially horizontally and parallel to the top board on the opening and closing movement of the flap.

It is particularly advantageous for the support arm to be connected to the flap such that a pivoting of the support arm relative to the flap is not possible. Due to such a fixed connection of the support arm, the flap carries out a pivot movement around the axis which is formed by the hinging of the support arm to the mounting panel.

In a preferred embodiment of the present invention, a rail is provided at the inner side of the flap which is L-shaped in cross-section, at whose limb extending substantially parallel to the inner side of the flap the end region of the support arm is arranged and whose other limb is arranged such that it cooperates with a damping member arranged on the wall in the closed state of the flap.

The support arm can be bent at right angles in its end region directed towards the flap and can be connected at this end region directly to the flap, can preferably be screwed to the flap.

In a preferred embodiment of the present invention, provision is made for the support arm to be connected to the flap in a region which protrudes beyond the adjoining carcass wall in the closed state of the flap. If the fitting in accordance with the invention is arranged on the upper side of the top board of a piece of furniture, provision can accordingly be made for the flap to protrude over the top board on its upper side and to be connected on its rear side in this protruding region to the fitting in accordance with the invention or to its support am.

Provision is made in a further embodiment of the present invention for the axle about which the support arm can be pivoted to be arranged in the rear region of the wall remote from the front side of the carcass member. The preferably rigid system of support arm and flap is accordingly moved around this pivot axle arranged in the rear region, for example, of the top board. The flap can be completely removed from the region flush with the interior space of the carcass member in this manner. The inner region of the carcass member is thus not limited either by the flap itself or by fitting parts in the open state of the flap.

In another aspect of the present invention, a support device is provided which exerts a force opposed to the closing force in the open state of the flap.

The support device can be a piston in cylinder unit, in particular a gas spring, or a telescopic cylinder which can be driven by an electric motor. Generally, any desired other support elements can also be used, for example an electromotively driven toothed rack and the like.

The support device can be pivotally connected to a mounting panel and to the support arm. The mounting panel can be the same mounting panel at which the support arm is pivotally supported. It is naturally equally possible for the support device to be hinged to a different mounting panel.

In a preferred aspect of the present invention, two support arms are provided. They can be components of a frame and be connected to one another by braces in one or both end regions. In this case, the flap is supported by two support arms which are components of a frame so that a better strength is achieved overall. The members, in particular the braces, forming the frame can in particular consist of extruded sections which can be connected to one another by correspondingly adapted connection parts. More than two support arms can naturally also be provided, which can be necessary in particular with very wide or high flaps.

Provision can be made to further increase the strength for a stiffening panel to be provided which is held in grooves of the extruded section.

The brace facing the flap can be formed by an L-shaped rail as shown and described herein. It is furthermore possible for the brace facing the flap to be formed by a rail having a C shape in plan view and being connected to the support arms, preferably screwed to them.

In another aspect of the invention, a damping member is provided on the wall of the carcass member and cooperates at least in the region of the closed position of the flap with a projection, for example a tab, provided on the support arm.

BRIEF DESCRIPTION OF THE DRAWINGS

Further details and advantages result from an embodiment shown in the drawing. There are shown:

FIG. 11: a partial plan view of the carcass member in accordance with FIG. 9;

FIG. 12: a side view of the support arm of the carcass member in accordance with the second embodiment;

FIG. 13: a side view of the lever connected rotatedly fixedly to the support arm and pivotally to the telescopic cylinder of the electric motor;

FIG. 13*a*: a detailed representation of the one end region of the lever in accordance with FIG. 13;

FIG. 14: a plan view of the lever in accordance with FIG. 13;

FIG. 15: a plan view of the mounting panel with a pivot axle of the support arm provided thereon; and FIG. 16: a plan view of the mounting panel for the pivotable fastening of the electromotively driven telescopic cylinder.

FIG. 1 shows the carcass element 1, which is closed by a flap 2, in a side view.

DECRIPTION OF THE PREFERRED EMBODIMENTS

Figure 3:
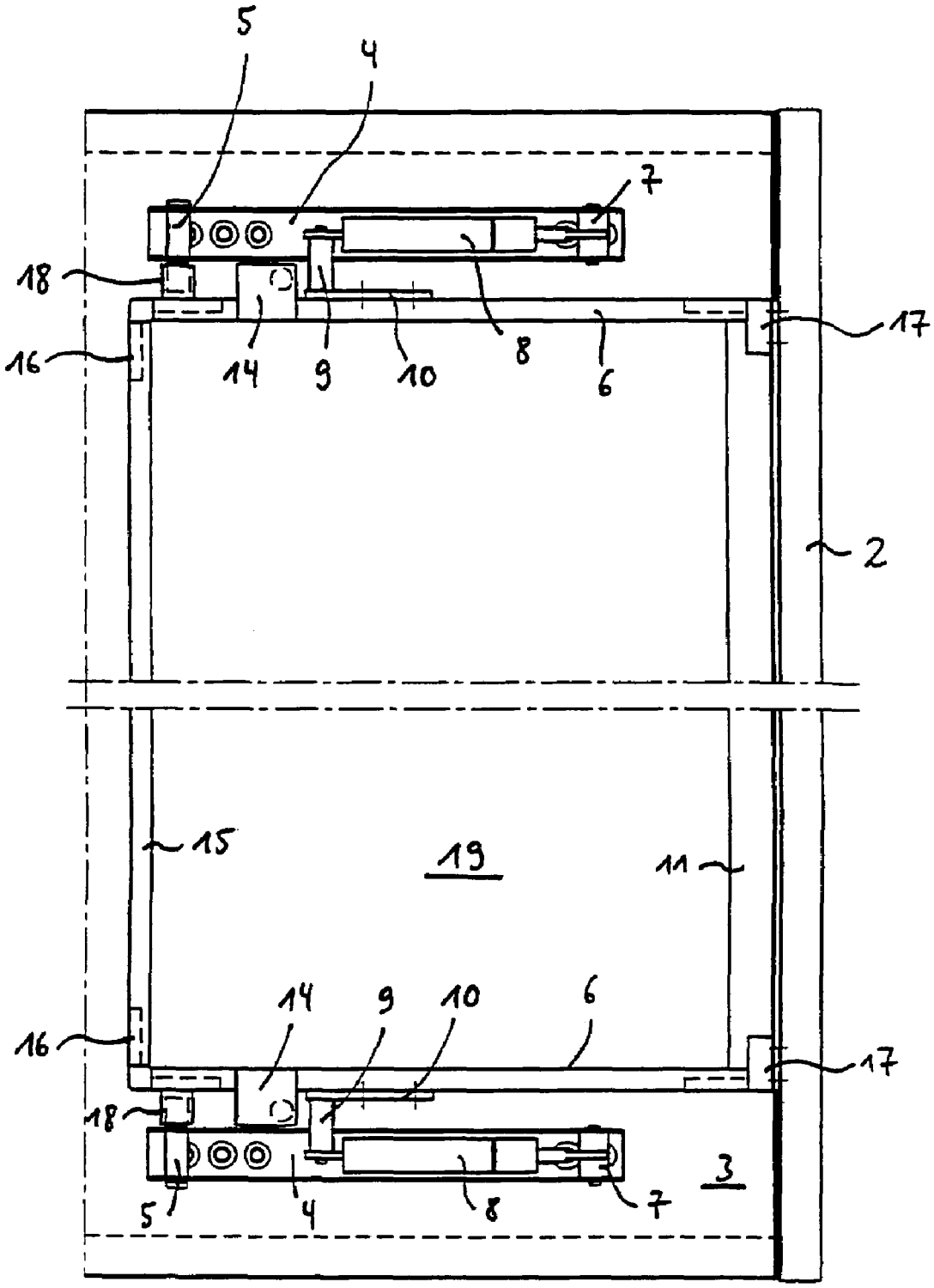
FIG. 3: a view from above of the carcass member in accordance with FIG. 1.
Figure 4:
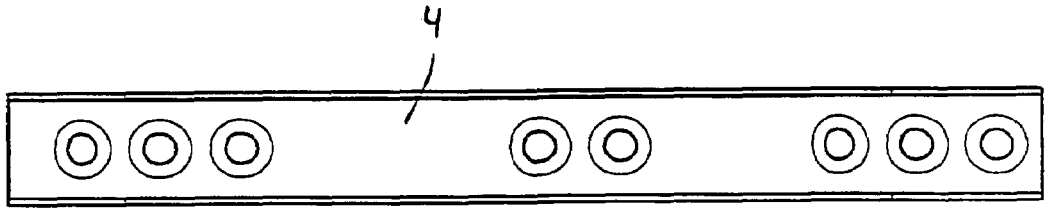
FIG. 4: a plan view of a mounting panel.

Two mounting panels 4 are located on the top board 3 of the carcass member 1, as can be seen from FIG. 3. FIG. 4 shows the mounting panel 4 in a plan view with a plurality of passage bores which serve to fix the mounting panel 4 on the top board 3 of the carcass member 1

The present invention is not restricted to mounting on the outer side of a top board. The fitting in accordance with the invention can likewise be arranged, for example, on the outer side of a side wall of the carcass member, with the flap being able to be moved in this case around pivot axes standing substantially vertical.

Figure 1:
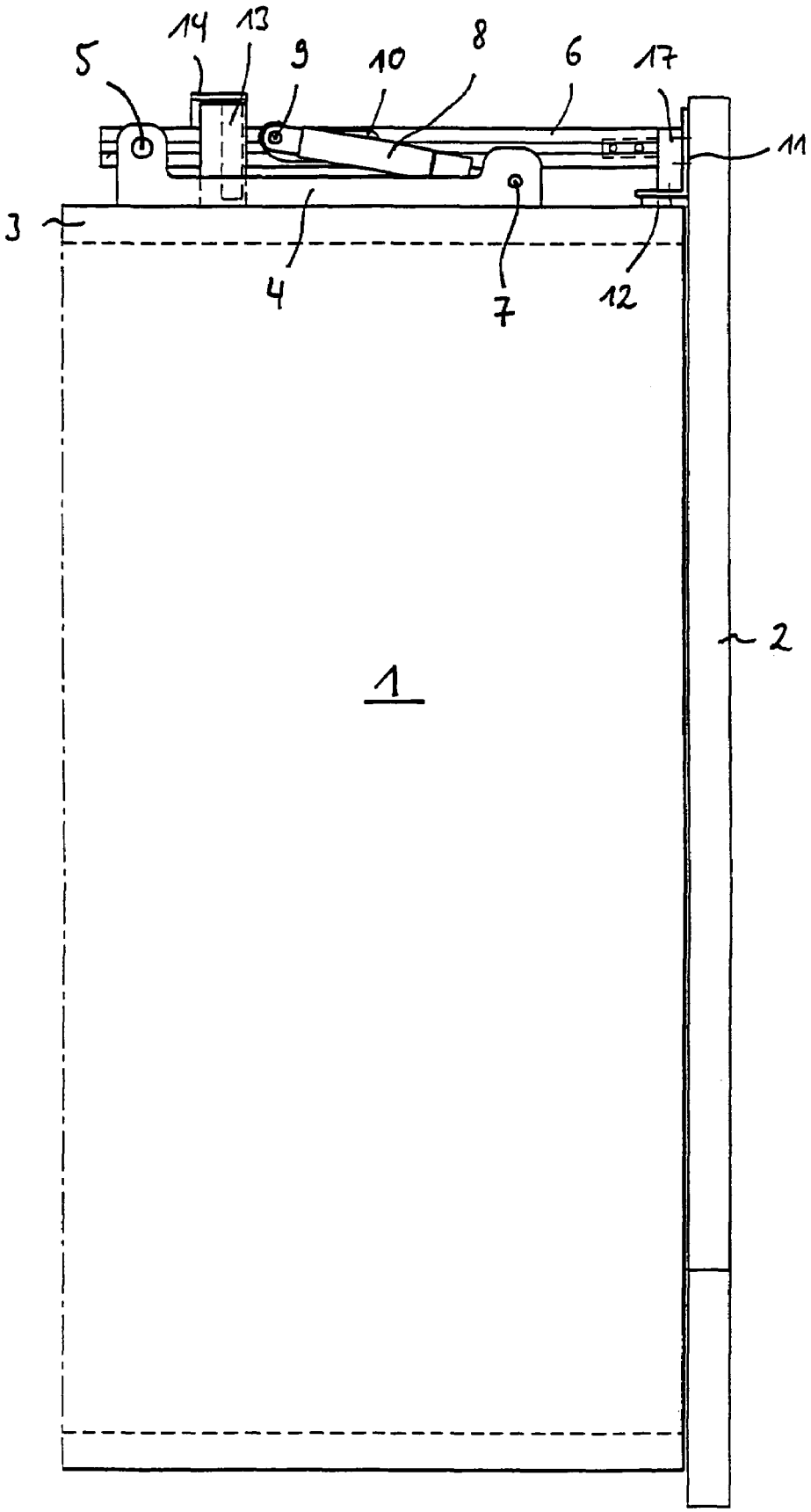
FIG. 1: a side view of a carcass member in accordance with the present invention in a first embodiment with a closed flap.
Figure 2:
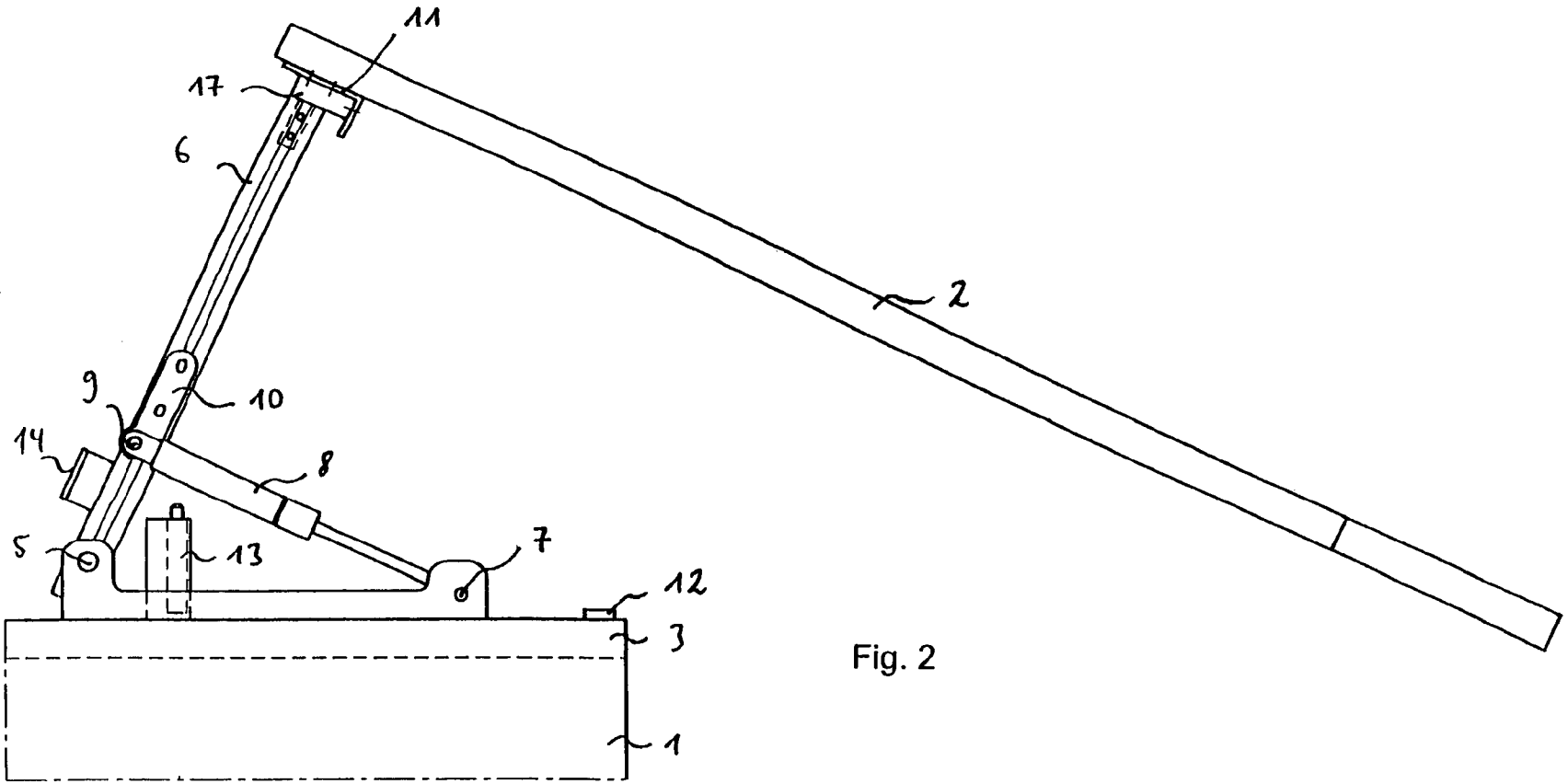
FIG. 2: a partial view of the carcass member in accordance with FIG. 1 with an open flap.
Figure 8:
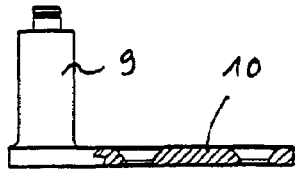
FIG. 8: a partially sectioned representation of an adjustable panel provided at the support arms and comprising a spigot having the pivot axle of the support device.

As can further be seen from FIGS. 1 to 3, support arms 6 are pivotally arranged on the mounting panels 4 via pivot axles 5 formed by pins. Each of the support arms 6 has an adjustable panel 10 which is screwed to the support arms 6 and which carries a spigot 9 in whose end region a pivot axle for the gas spring 8 is formed, as can be seen from FIGS. 1 and 3 and in particular from FIG. 8 which shows the panel 10 with spigot 9 in a partially sectioned representation. The panel 10 has bores to receive screws by means of which the panel 10 is fixed to the support arm 6.

The gas spring 8 is pivotally supported by means of the axle 7 formed by pin on the same mounting panel 4 as the support arm 6. The support arm 6 is accordingly pivotably connected to the mounting panel 4 by means of the axle 5 and the gas spring 8 is pivotably connected to the mounting panel 4 by means of the axle 7. Furthermore, the gas spring 8 is pivotally arranged in its other end region on the spigot 9 of the panel 10 which is screwed to the support arm 6.

Figure 5:
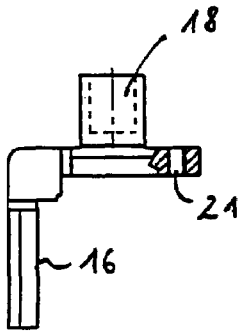
FIG. 5: a partially sectioned representation of a connection member for the frame including the support arms.
Figure 6:
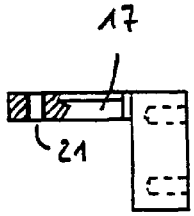
FIG. 6: a partially sectioned representation of a connection member for the connection of the support arms to a rail.

The support arm 6 is screwed at its end region directed towards the flap 2 to an L-shaped rail 11. The connection member 17 in accordance with FIG. 6 serves this purpose. It has the threaded bore 21 by means of which the connection member 17 can be screwed to the support arm 6. The connection member 17 furthermore has two blind bores by means of which the screw connection to the rail 11 takes place in accordance with FIGS. 1 to 3. This end region of the support arm 6 is accordingly fixedly connected, that is not pivotally, to the L-shaped rail 11 and thus also to the flap 2. The rail 11 is screwed to the flap 2. The connection member 16 is introduced into the support arm 6 in its other end region remote therefrom and is likewise screwed to it by means of a threaded bore 21. As can be seen from FIG. 5, the connection member 16 has a blind bore 18 in which the pin forming the axle 5 is received which forms the pivot axle 5 of the support arm 6 on the mounting panel 4.

Figure 7:
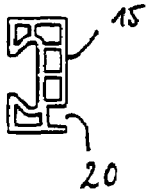
FIG. 7: a cross-sectional representation of the extruded section forming the frame.

As can be seen from FIG. 3, the described fitting is made in duplicate on the upper side of the top board 3 of the carcass member 1. The two support arms 6 are connected to one another by means of the brace 15 on the side remote from the flap 2 and to the L-shaped rail 11 on the side facing the flap, as can be seen from FIG. 3. The brace 15 and the support arms 6 have an extruded section which is shown in cross-section in FIG. 7. It has recesses to receive the connection members 16, 17 on its side shown at the left in FIG. 7. Furthermore, the groove 20 can be recognised which serves to accept a stiffening panel 19 which is shown in FIG. 3. The stiffening panel 19 has the object of increasing the strength of the frame having the support arms 6.

It can furthermore be seen from FIGS. 1 to 3 that the tab-shaped projection 14 is provided on the support arm 6 and cooperates in the region of the closed position with a damping member 13 on the upper side of the top board 3 of the carcass member 1 and in this manner damps the closing movement of the flap 2. Furthermore, a further damping member 12 is provided in the front region of the top board 3 and cooperates with the limb of the L-shaped rail 11 extending horizontally in the closed flap position.

On the opening of the flap 2 from the closed position shown in FIG. 1 into the pivoted position shown in FIG. 2, the support arm 6 is pivoted counter-clockwise around the axle 5. At the same time, the gas spring 8 is moved out and pivoted slightly clockwise, as can be seen from FIG. 2. The gas spring 8 supports the flap 2 in its open position. If the flap 2 should be closed, it is pivoted clockwise in accordance with FIG. 2 against the force of the gas spring 8, with the support arm 6 likewise being pivoted clockwise around the axle 5 and the gas spring 8 being pivoted counter-clockwise around the axle 7. Comparatively simple kinematics and a comparatively simple design of the fitting are possible due to the fixed, non-pivotable fixing of the support arm to the flap 2. The flap 2 carries out a pivot movement around the axle 5 due to its fixed connection to the support arm 6, with said axle 5 forming the hinge of the support arm 6 on the mounting panel 4.

Figure 9:
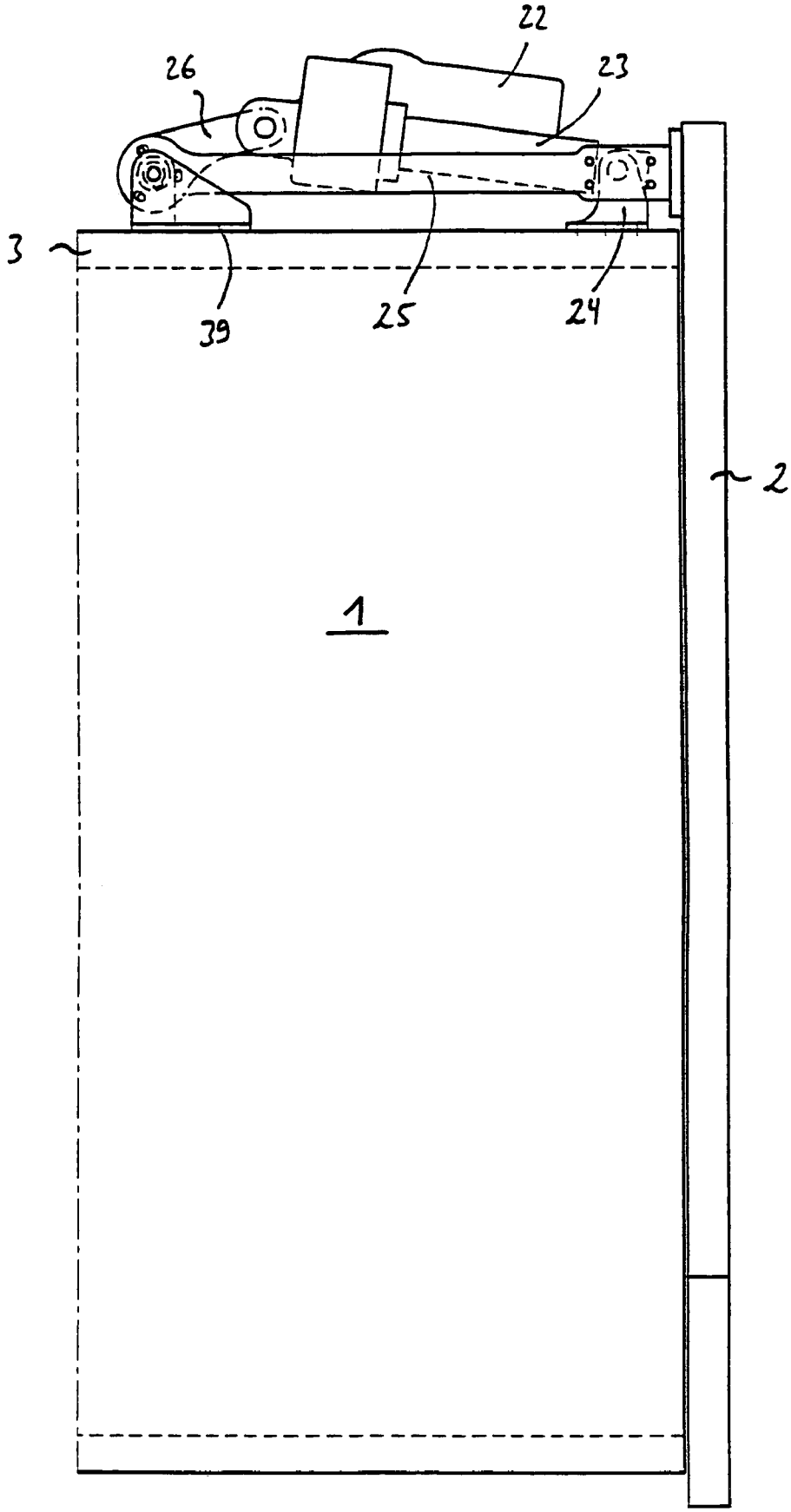
FIG. 9: a side view of a carcass member in accordance with the present invention in a second embodiment with a closed flap.
Figure 10:
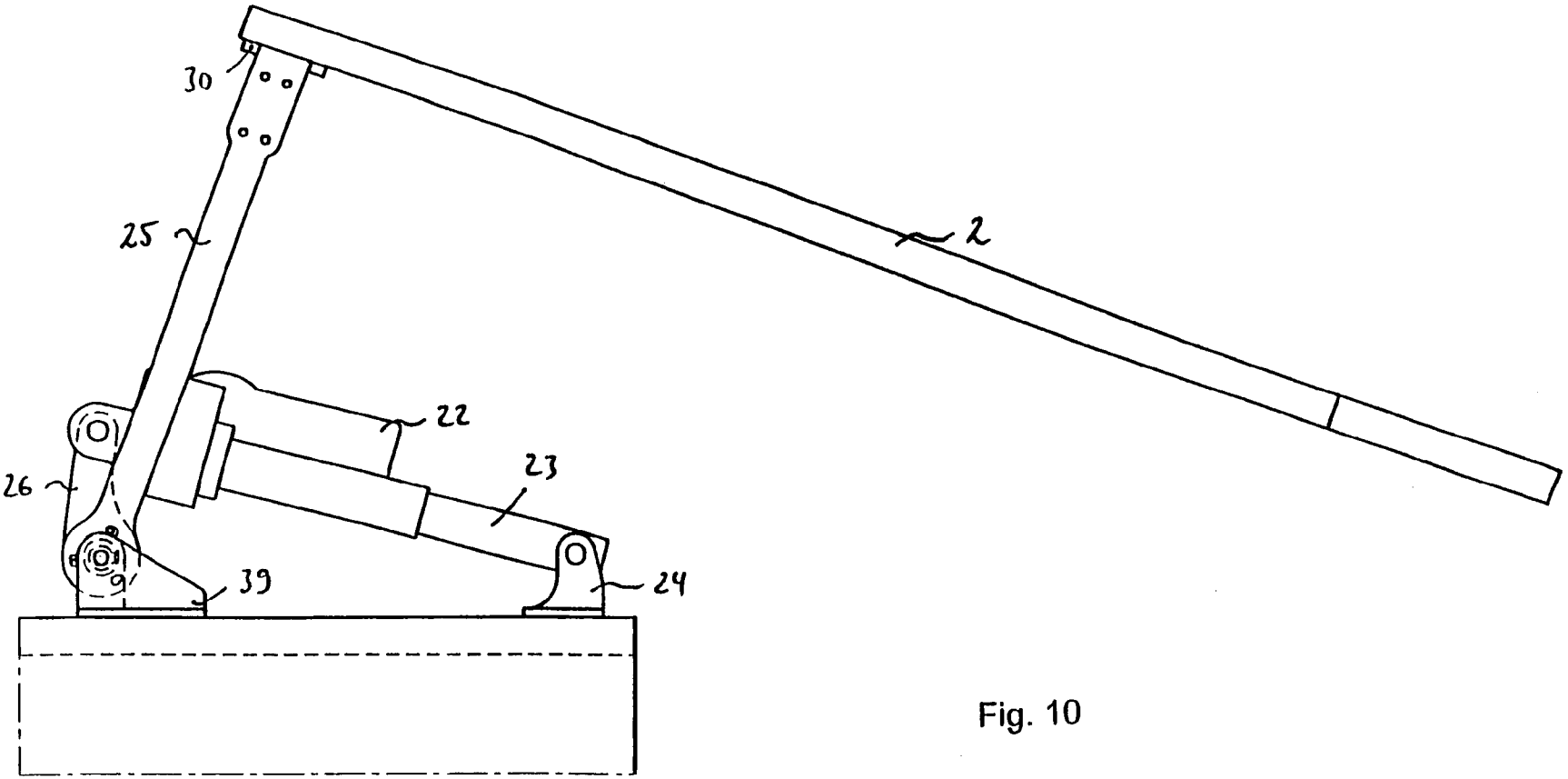
FIG. 10: a partial view of the carcass member in accordance with FIG. 9 with an open flap.

FIG. 9 shows a second embodiment of the present invention in which the fitting is moved by an electric motor 22 with an extensible telescopic cylinder 23. The telescopic cylinder 23 is pivotally connected to the mounting panel 24 in one of its end regions, as can be seen, for example, from FIGS. 9 to 11. In its other end region, the telescopic cylinder 23 is pivotally connected to the lever 26 which is shown in the FIGS. 13, 13*a* and 14. The lever 26 is connected via a washer 27 arranged offset rotationally fixedly to the support arm 25 which is shown in detail in FIG. 12. The lever 26 can be connected by a screw connection to the threaded bores 29 of the support arm 25 by means of the elongate holes 28, with the lever 26 being adjustable in angle with respect to the support arm 25 to be able to adapt motors 22 arranged on both sides. The telescopic cylinder 23 is indirectly pivotally connected to the support arm 25 via the lever 26.

The support arm 25 is pivotally connected in an end region to the axle 34 formed by a spigot. Said axle is located on the mounting panel 39 which is shown in FIG. 15 and in FIG. 11 and which is arranged in the rear region of the top board 3 of the carcass member 1. In its other end region, the support arm 25 has a section 30 bent at right angles by means of which the support arm 25 is screwed to the flap 2.

Two of the said fittings are also provided on the top board 3 of the carcass member 1 in this embodiment. They are connected to one another by means of the yoke 31, which is C-shaped in plan view, and via the brace 33 made as a bar. The C-shaped rail 31 serves to stiffen the apparatus. As can be seen from FIG. 11, it is supported at the rear of the flap 2.

As can be seen from FIG. 13*a*, the lever 26 has a bore 32 with a recess. A corresponding lug of the bar forming the brace 33 can be guided into this recess so that the bar is received rotatedly fixedly in the bore 32 of the lever 26 by means of shape matching. The bar 33 does not only serve the stiffening of the total construction, but also to realise a synchronous rotational movement at both sides of the flap 2.

FIG. 16 finally shows the mounting panel 24 on which the end region of the telescopic cylinder 23 of the electric motor 22 is pivotally supported by means of a pin. As can be seen from FIG. 11, the mounting panel 24 is also mounted on the outer side of the top board 3.

The two mounting panels 24 and 39 are made as two separate panels in the present embodiment. The use of a common mounting panel is naturally also feasible.

To open the flap 2, the electric motor 22 is actuated and the telescopic cylinder 23 is moved out. The lever 26 is pivoted counter-clockwise out of its position shown in FIG. 9, as can be seen from a comparison of FIGS. 9 and 10. The support arm 25 and the flap 2 fixedly connected to it also experience a pivotal counter-clockwise movement due to the rotationally fixed connection of the lever 26 to the support arm 25. The flap is moved away from the opening region of the carcass member 1 in accordance with FIG. 10, whereby its interior space is completely accessible. On the opening movement, the telescopic cylinder 23 undergoes a pivotal movement clockwise around the pivot axle provided on the mounting plate 24.

In the open position, the moved out telescopic cylinder 23 supports the flap 2. In the closing movement, the aforesaid process takes place in reverse direction until the flap 2 adopts its closed position visible from FIG. 9.

As can be seen from the drawings showing the embodiments, all pivot axes extend parallel to the wall on which the mounting panel(s) is/are arranged. This wall is formed by the top board of the carcass member in the embodiments. Alternatively, any other wall of the carcass member can also be considered for the mounting of the fitting in accordance with the invention.

Both embodiments have the advantage that no fitting parts are present on the inner side of the carcass member so that the interior space can be utilised completely both in the closed position and in the open position of the flap. The fitting parts are all mounted on the upper side of the top board in the embodiment shown in the drawing, whereby a comparatively simple mounting can moreover be realised. The flap undergoes a pivotable movement around the pivot axis of the support arm on the mounting panel due to the rigid connection of the support arms to the flap shown in the embodiments. The desired movement of the flap can be realised by a comparatively simple design of the fitting which is easy to produce.

The invention claimed is:

1. A carcass member (1) comprising a flap (2) by which the carcass member (1) can be closed and a single piece mounting panel (4, 39), and a support arm (6, 25) connected in its end region to the flap (2) and mounted upon the mounting panel (4, 39) in turn being fixedly mounted on the outer side of a wall of the carcass member (1), the support arm (6, 25) being pivotally mounted at one end thereof about a pivot axle (5) fixedly mounted upon the mounting panel (4, 39) and movable in direction transverse to the surface of the side of the wall to which the mounting panel (4, 39) is mounted, and the carcass member (1) further including a biasing member (8) connected at one end to the support arm (6, 25) and an opposite end to the mounting panel (4, 39) for biasing the flap (2) to an open position.

2. A carcass member (1) in accordance with claim 1, wherein the wall is formed by a top board (3) of the carcass member.

3. A carcass member (1) in accordance with claim 2, wherein the support arm (25) is bent at right angles in its end region (30) directed towards the flap (2) and is connected at this end region (30) to the flap (2).

4. A carcass member (1) in accordance with claim 3, wherein the support arm (6, 25) is connected to the flap (2) in a region which protrudes beyond the adjoining carcass wall in the closed state of the flap (2).

5. A carcass member (1) in accordance with claim 2, wherein the support arm (6, 25) is connected to the flap (2) in a region which protrudes beyond the adjoining carcass wall in the closed state of the flap (2).

6. A carcass member (1) in accordance with claim 1, wherein the support arm (25) is bent at right angles in its end region (30) directed towards the flap (2) and is connected at this end region (30) to the flap (2).

7. A carcass member (1) in accordance with claim 1, wherein the support arm (6, 25) is connected to the flap (2) in a region which protrudes beyond the adjoining carcass wall in the closed state of the flap (2).

8. A carcass member (1) in accordance with claim 1, further including an axle (5,34) about which the support arm (6, 25) is pivotally arranged in the rear region of the wall remote from the front of the carcass member (1).

9. A carcass member (1) in accordance with claim 8, wherein said support arm (6, 25) is pivotally mounted upon the axle (5, 34) in an end region opposite the end region at which said support arm (6, 25) is connected to said flap (2).

10. A carcass member (1) in accordance with claim 1, wherein an end (9) of said biasing member (8) connected to said support arm (6, 25) is positioned, at all times, further away from the mounting panel (4, 39) than an opposite end (7) of said biasing member (8) connected to the mounting panel (4, 39).

11. A carcass member (1) comprising a flap (2) by which the carcass member (1) can be closed and a single piece mounting panel (4, 39), and a support arm (6, 25) connected in its end region to the flap (2) and mounted upon the mounting panel (4, 39) in turn being fixedly mounted on the outer side of a wall of the carcass member (1), the support arm (6, 25) being pivotally mounted upon the mounting panel (4, 39) and movable in direction transverse to the surface of the side of the wall to which the mounting panel (4, 39) is mounted, and the carcass member (1) further including a biasing member (8) connected at one end to the support arm (6, 25) and an opposite end to the mounting panel (4, 39) for biasing the flap (2) to an open position, wherein a rail (11) is provided at the inner side of the flap which is L-shaped in cross-section, said rail having a first limb extending substantially parallel to the inner side of the flap where the end region of the support arm (6) is arranged and a second limb arranged such that it cooperates with a damping member (12) arranged on the wall in the closed state of the flap (2).

12. A carcass member (1) comprising:

a flap (2) by which the carcass member (1) can be closed and a single piece mounting panel (4, 39) and a support arm (6, 25) connected in its end region to the flap (2) and mounted upon the mounting panel (4, 39), with the mounting panel (4, 39) being fixedly mounted on the outer side of a wall of the carcass member (1) and the support arm (6, 25) being pivotally mounted at one end thereof about a pivot axle (5) fixedly mounted upon the mounting panel (4, 39) and movable in direction transverse to the surface of the side of the wall to which the mounting panel (4, 39) is mounted, the carcass member (1) further including a biasing member (8) connected at one end to the support arm (6, 25) for biasing the flap (2) to an open position, wherein the biasing member (8) is pivotally connected at a second end to the mounting panel (4, 39).

13. A carcass member (1) in accordance with claim 12, wherein the biasing member (8) comprises a piston in cylinder unit.

14. A carcass member (1) in accordance with claim 13, wherein the biasing member (8) is pivotally connected to the mounting panel (4, 24) and to the support arm (6, 25).

15. A carcass member (1) in accordance with claim 13, wherein the biasing member includes a gas spring (8).

16. A carcass member (1) in accordance with claim 12, wherein the biasing member (8) is a gas spring pivotally connected to the mounting panel (4, 24) and to the support arm (6, 25).

17. A carcass member (1) in accordance with claim 12, wherein the biasing member includes a telescopic cylinder (23) driven by an electric motor (22).

18. A carcass member (1) in accordance with claim 12, further including an axle (5,34) about which the support arm (6, 25) is pivotally mounted in an end region opposite the end region at which said support arm (6, 25) is connected to said flap (2), said axle (5, 34) being mounted in the rear region of the wall remote from the front of the carcass member (1).

19. A carcass member (1) comprising:

a flap (2) by which the carcass member (1) can be closed and a single piece mounting panel (4, 39) and a support arm (6, 25) connected in its end region to the flap (2), with the mounting panel (4, 39) being fixedly mounted on the outer side of a wall of the carcass member (1) and the support arm (6, 25) being pivotally mounted at one end thereof about a pivot axle (5) fixedly mounted upon the mounting panel (4, 39) and movable in direction transverse to the surface of the side of the wall to which the mounting panel (4, 39) is mounted, the carcass member (1) further including a biasing member (8) connected at one end to the support arm (6, 25) and an opposite end to the mounting panel (4, 39) for biasing the flap (2) to an open position, wherein two support arms (6, 25) are provided.

20. A carcass member (1) in accordance with claim 19, wherein the two support arms (6, 25) are connected to one another by braces (11, 15, 31, 33) in one or both end regions.

21. A carcass member (1) in accordance with claim 19, further including an axle (5,34) about which the support arms (6, 25) are pivotally mounted in end regions opposite the end regions at which said support arms (6, 25) are connected to said flap (2), said axle (5, 34) being mounted in the rear region of the wall remote from the front of the carcass member (1).

22. A carcass member (1) comprising a flap (2) by which the carcass member (1) can be closed and comprising a mounting panel (4, 39) and two support arms (6, 25) connected in end regions to the flap (2) and mounted upon the mounting panel (4, 39) in turn being mounted on the outer side of a wall of the carcass member (1) and the support arms (6, 25) being pivotally arranged on the mounting panel (4, 39), wherein the two support arms (6, 25) are connected to one another by braces (11, 15, 31, 33) in one or both end regions, and the brace facing the flap (2) is formed by an L-shaped rail (11) in cross-section, said rail having a first limb extending substantially parallel to the inner side of the flap where the end region of the support arm (6) is arranged and a second limb arranged such that it cooperates with a damping member (12) arranged on the wall in the closed state of the flap (2).

23. A carcass member (1) in accordance with claim 22, further including an axle (5,34) about which the support arms (6, 25) are pivotally mounted in end regions opposite the end regions at which said support arms (6, 25) are connected to said flap (2), said axle (5, 34) being mounted in the rear region of the wall remote from the front of the carcass member (1).

24. A carcass member (1) comprising a flap (2) by which the carcass member (1) can be closed and a single piece mounting panel (4, 39), and a support arm (6, 25) connected in its end region to the flap (2) with the mounting panel (4, 39) being fixedly mounted on the outer side of a wall of the carcass member (1), the support arm (6, 25) being pivotally mounted upon the mounting panel (4, 39) and movable in direction transverse to the surface of the side of the wall to which the mounting panel (4, 39) is mounted, and the carcass member (1) further including a biasing member (8) connected at one end to the support arm (6, 25) for biasing the flap (2) to an open position, wherein two support arms (6, 25) are provided, the two support arms (6, 25) are connected to one another by braces (11, 15, 31, 33) in one or both end regions, and the brace facing the flap (2) is formed by a rail (31) which is C-shaped in plan view and which is connected to the support arms (25).

25. A carcass member (1) comprising a flap (2) by which the carcass member (1) can be closed and a single piece mounting panel (4, 39), and a support arm (6, 25) connected in its end region to the flap (2) and mounted upon the mounting panel (4, 39) in turn being fixedly mounted on the outer side of a wall of the carcass member (1), the support arm (6, 25) being pivotally mounted upon the mounting panel (4, 39) and movable in direction transverse to the surface of the side of the wall to which the mounting panel (4, 39) is mounted, and the carcass member (1) further including a biasing member (8) connected at one end to the support arm (6, 25) and an opposite end to the mounting panel (4, 39) for biasing the flap (2) to an open position, wherein a damping member (13) is provided on the wall of the carcass member and cooperates at least in the region of the closed position of the flap (2) with a projection (14) provided on the support arm (6).

26. A carcass member (1) in accordance with claim 25, wherein the wall is formed by a top board (3) of the carcass member.

27. A carcass member (1) in accordance with claim 26, wherein the support arm (6, 25) is connected to the flap (2) in a region which protrudes beyond the adjoining carcass wall in the closed state of the flap (2).

* * * * *